United States Patent [19]

Gerphagnon et al.

[11] 4,437,964

[45] Mar. 20, 1984

[54] ASSEMBLY FOR SPOT FEEDING ALUMINA TO AN ELECTROLYTIC TANK FOR THE PRODUCTION OF ALUMINUM

[75] Inventors: Jean-Louis Gerphagnon; Claude Wolter, both of St. Jean De Maurienne, France

[73] Assignee: Aluminium Pechiney, St. Jean de Maurienne, France

[21] Appl. No.: 496,244

[22] Filed: May 19, 1983

[30] Foreign Application Priority Data

May 27, 1982 [FR] France ..... 82 09700

[51] Int. Cl.[3] ..... C25C 3/14; C25C 3/22

[52] U.S. Cl. ..... 204/245; 204/247

[58] Field of Search ..... 204/245-247, 204/67

[56] References Cited

U.S. PATENT DOCUMENTS

| | | | |
|---|---|---|---|
| 3,216,918 | 11/1965 | Duclaux | 204/245 |
| 3,372,106 | 3/1968 | Chambran | 204/245 |
| 3,400,062 | 9/1968 | Bruno et al. | 204/67 |
| 3,673,075 | 6/1972 | Kibby | 204/245 |
| 3,679,555 | 7/1972 | Duclaux et al. | 204/67 |
| 3,681,229 | 8/1972 | Lowe | 204/243 R |
| 3,689,229 | 9/1972 | Lane et al. | 23/308 S |
| 3,714,002 | 1/1973 | Kibby | 204/67 |
| 3,729,399 | 4/1973 | Kibby | 204/67 |
| 3,901,787 | 8/1975 | Niizeki et al. | 204/245 |
| 4,377,452 | 3/1983 | Casdas | 204/67 |

FOREIGN PATENT DOCUMENTS

| | | |
|---|---|---|
| 2487386 | 7/1980 | France . |
| 2483964 | 12/1981 | France . |
| 2058137 | 9/1980 | United Kingdom . |

*Primary Examiner*—Howard S. Williams
*Assistant Examiner*—T. L. Williams
*Attorney, Agent, or Firm*—Dennison, Meserole, Pollack & Scheiner

[57] ABSTRACT

The invention concerns a detachable assembly for spot feeding alumina to a tank for the production of aluminum. A fixed hopper is made integral with horizontal metal girders which form at least part of its side walls. The hopper is provided with a bottom aperture for discharge of alumina therethrough. An impervious metal case is positioned vertically in said hopper with the upper part of the case open and substantially at the level of the upper part of the hopper. The case has two substantially parallel vertical branches, the first branch opening, at its lower portion, outside the hopper, and the second branch opening, at its lower portion, inside the hopper, in the immediate vicinity and on the axis of the aperture for the discharge of alumina.

4 Claims, 3 Drawing Figures

ASSEMBLY FOR SPOT FEEDING ALUMINA TO AN ELECTROLYTIC TANK FOR THE PRODUCTION OF ALUMINUM

BACKGROUND OF THE INVENTION

The invention concerns a detachable assembly for spot feeding alumina to an electrolytic tank for the production of aluminum by the Hall-Heroult process.

In recent years the operation of tanks producing aluminum has been gradually automated, thereby improving the energy balance and the smoothness of operation, restricting human intervention, and improving the recovery of fluorine-containing effluent.

One of the essential factors in ensuring the smooth running of a tank producing aluminum by electrolysis of alumina dissolved in molten cryolite is the timing of the introduction of alumina into the bath.

Until recently the alumina was fed in by depositing it on the solidified electrolytic crust covering the tank and by periodically breaking the crust with picks. This caused the alumina to drop into the bath in large and uncontrolled quantities.

Processes of this type have been described, for example, in U.S. Pat. Nos. 3,216,918; 3,372,106; and 3,679,555. These patents correspond respectively to French Pat. Nos. 1,245,598; 1,526,766; and 2,036,896.

The tendency now is to feed in the alumina in a controlled and regular manner to keep the alumina concentration of the electrolyte permanently within a predetermined range with a view to obtaining the best possible yield.

For this purpose the alumina is fed in successive doses of controlled weight into one or more holes which are kept permanently open in the electrolyte crust (a system known as "spot feeding"). Systems of this type have been described particularly in French Pat. Nos. 2,099,434 (ALCOA), 2,264,098 (NIPPON LIGHT METALS), 2,465,016 (ALUSUISSE), 2,483,964, and 2,483,965 (ALUMINIUM DE GRECE), and 2,487,386 (ALUMINIUM PECHINEY), and also in U.S. Pat. Nos. 3,400,062 (ALCOA), and 3,689,229 (ALCOA). Such systems generally consist of storage means and a means for dispensing alumina into the tanks at one or more points, the alumina dispensing means frequently being combined with the means for forming a hole in the crust of solidified electrolyte.

The storage means may be either of the centralized type with the alumina being distributed into each tank by an air-slide or pneumatic or fluidizing conveyor, or a localized type with one or more hoppers per tank which are periodically recharged.

The disadvantage of these systems, particularly when the hopper is fixed, resides in the difficulty of gaining access to the means for breaking the crust and dosing and dispensing alumina. Because of the abrasive nature of the product, these means require relatively frequent maintenance which has to be carried out on the tank under very difficult conditions, arising from the heat, the liberation of fluorine-containing gases, electric potential on the superstructure, and strong magnetic fields which cause the tools to stick and make handling difficult.

As a means of resolving this problem it has been proposed that the hopper, or the unit comprising the hopper, the crust breaker and the dosing means, should be made detachable or movable on a rail integral with the superstructure.

However, the detachable hopper system has many disadvantages. It is expensive to set up since it necessitates making large items interchangeable, thus requiring very small manufacturing tolerances. Further, outside the tanks it is necessary to provide for storage of exchange hoppers and hoppers being repaired, which require appropriate supports and take up space in the building.

In addition, the steel of the hopper does not contribute toward the strength of the superstructure of the tank or toward forming the hoods for sucking in the gases. The capacity of detachable hoppers is very substantially reduced (up to 30%) by the play or clearances necessary for the exchanging processes. The hoppers therefore have to be filled frequently and operation is less reliable.

When a worn out hopper is being exchanged or a hopper dismantled to gain access to the crust breaking and dosing means, the alumina has to be emptied out, then the replacement hopper filled with alumina to bring it into operation. These transfers of alumina make dust fly, which is prejudicial to the proper operation of the tank mechanisms and to working conditions. Such problems lengthen the time taken by the exchange and thus the time during which the tank is not being fed with alumina.

Furthermore, the connection between the detachable hopper and the superstructure of the tank must be as impervious as possible to the tank gases, in order to increase the amount recovered. Such imperviousness is difficult to maintain with large components of the type involved.

Finally, an inevitable consequence of the use of a detachable hopper is the presence of alumina in the maintenance workshop, since it is not possible to empty the hoppers completely. Special precautions therefore have to be taken throughout in order to prevent the tools, machines and the parts being maintained from being contaminated with the highly abrasive alumina.

SUMMARY OF THE INVENTION

The invention enables all these disadvantages to be overcome. It concerns a detachable system for spot feeding alumina to a tank for the production of aluminum by electrolysis of alumina dissolved in molten cryolite. The system comprises a stationary metal hopper made integral with the superstructure of the tank by connecting means impervious to the gases liberated by the tank, means for forming a hole in the crust of solidified electrolyte which covers the surface of the tank in normal operation, and means for feeding controlled doses of alumina into the hole. In this arrangement, the stationary hopper is equipped with a lower aperture for discharge of the alumina, and an internal impervious metal case with the upper part of the case open and at least at the level of the upper part of the hopper. The lower part of the case has two substantially parallel branches, the first branch discharging or opening outside the hopper, and the second branch discharging, at its bottom portion, inside the hopper in the immediate vicinity and on the axis of the aperture for the discharge.

The crust breaking means is located in the first branch of the case and the alumina feed means in the second branch. Both means are fixed at the top to a common support, which substantially seals about the opening at the top of the metal case. The outlet aperture of the hopper is extended by tubular means, which discharges or opens above and in the immediate vicinity of the hole in the electrolytic crust.

The means for dosing the alumina is of the volumetric type and comprises a tubular member, of predetermined volume, fitted at the top and bottom with controlled sealing means. The top of the tubular member opens at the level of the space between the lower end of the second branch of the case and the outlet aperture of the hopper, while the bottom of the tubular member discharges into the tubular means below and fixed to said outlet aperture.

DESCRIPTION OF PREFERRED EMBODIMENTS

Figure 1:
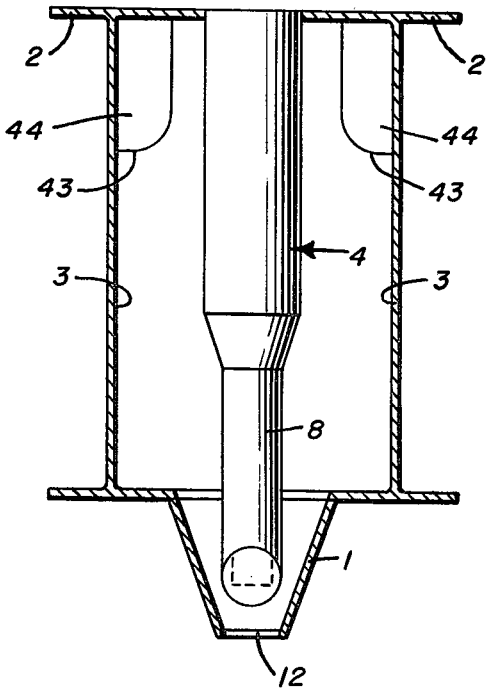
FIG. 1 is a vertical cross section through the hopper with the internal case shown in elevation.
Figure 2:
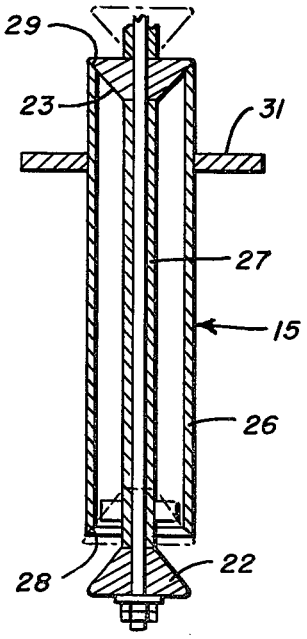
FIG. 2 is a vertical section through the feed control.
Figure 3:
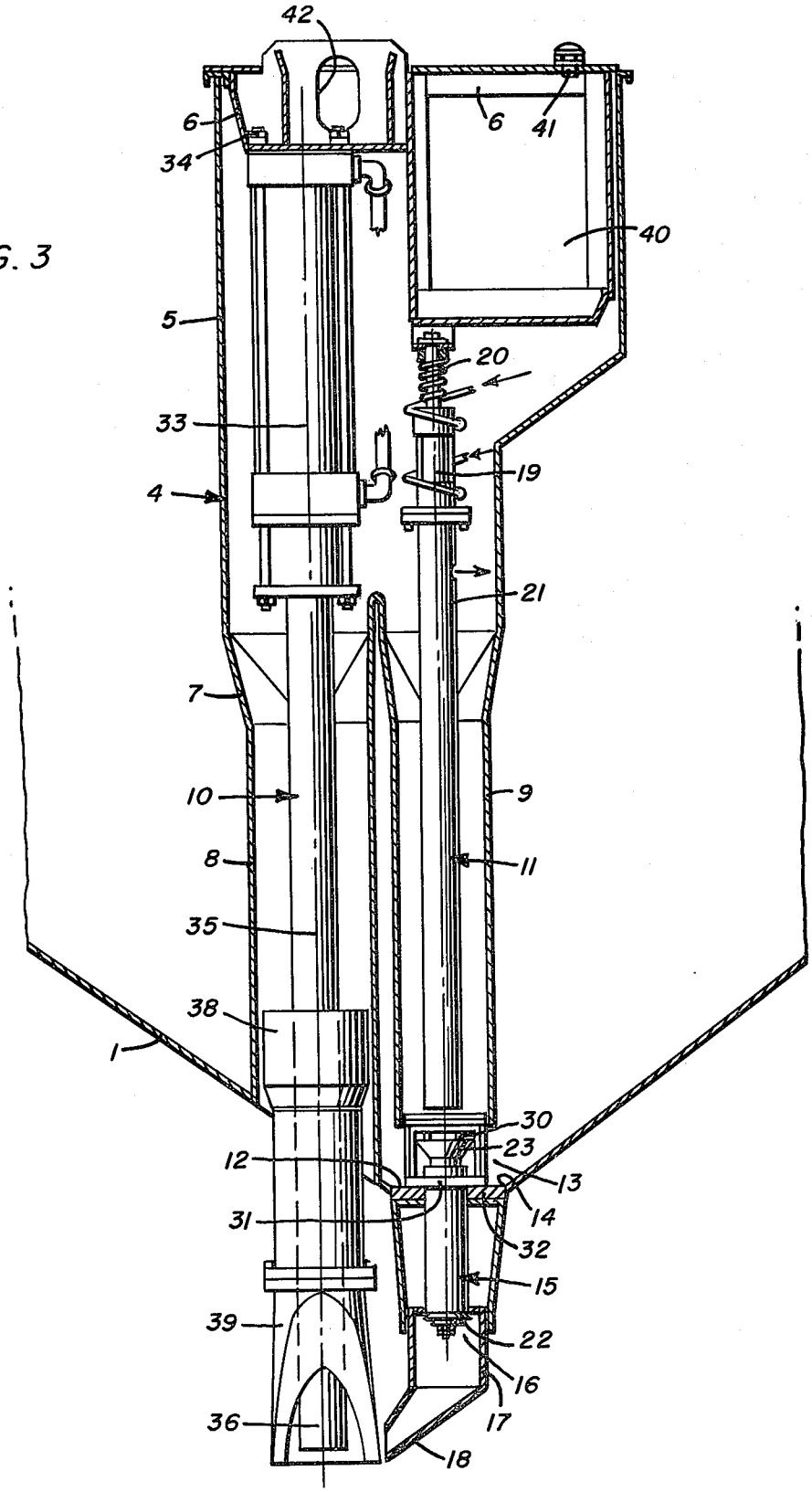
FIG. 3 is a vertical section through the hopper and case with the detachable perforating and spot feed arrangement shown in elevation.

The hopper 1 for holding the alumina is integral with and formed partially by the horizontal girders 2 forming the superstructure of the tank. The two internal surfaces 3 of the girders 2 form the upper side walls of the hopper. The girders 2 in particular support the anodes and their height adjusting and electricity supply system. The hopper 1 has a sheet steel case or sleeve 4 extending downwardly through it. This case 4 may be arranged near the center of the hopper, preferably aligned with the lowest point of the hopper, and may be equally supported by the walls.

The upper part 5 of the case 4 engages a frame 6 which acts as a support for the perforator, the feed control, and the apparatus controlling the jacks, for purposes of maintenance or mounting on the tank. The frame 6 further provides a seal between the upper part 5 of the case 4 and the inside of the hopper 1.

The lower part 7 of case 4 is divided into two parallel branches 8 and 9. The first branch 8 receives the means for breaking through the crust. This branch 8 is basically a tube which is sealed off from the hopper 1 and opens through the bottom of the hopper, forming a passage for a fully assembled perforating means 10. The second branch 9, similarly of a tubular configuration, receives the dispenser and feed control 11. This branch 9 ends in the immediate vicinity of, and spaced slightly above, the outlet aperture 12 of the hopper along the axis thereof. A space 13 of a few centimeters is provided, this space 13 letting the alumina pass from the hopper to the inlet 14 of the feed control 15. A tube 17 is mounted about the outlet 16 of the feed control, as by welding, with its upper level slightly overlapping the bottom of the hopper. The bottom of tube 17 discharges into a spout 18, which directs the alumina to the hole made in the crust by the perforator 10.

The dispensing and feed control unit 11 comprises a vertically extending pneumatic jack 19 fixed at its upper end to frame 6 and biased downward by means of a spring 20. The spring 20 provides a resilient connection between the feed control and the frame and enables the feed control to be pressed against the bottom of the hopper. An extension 21 depends from jack 19 and carries two conical valves or seals 22, 23 of the feed control. Extension 21 also acts as a vent. A volume control chamber 15, comprising a tubular member 26, has a rod 27 therein actuated by jack 19, for vertical sliding movement within member 26. The rod 27 mounts the two conical seals 22, 23 which cooperate with lower and upper conical bearing surfaces, 28 and 29 respectively, on the lower and upper ends of member 26, the seals alternately sealing these lower and upper ends.

The tubular member 26 aligns with the lower end of branch 9 and is joined coaxially thereto by a plurality of ribs 30 with wide spaces left between the ribs. The alumina flows between the ribs 30 by gravity when the upper seal 23 is in the raised position, thereby filling the tubular member 26. The capacity of the tubular member 26 corresponds to a unit dose of alumina.

Extension of jack 19 moves central rod 27 downward and moves seal 23 into a lowered sealing position on the upper bearing surface 29. At the same time, seal 22 moves downward from its bearing surface 28, thus allowing the dose of alumina to flow out through the tube 17 and dispensing spout 18, directly into the aperture made in a crust of electrolyte by the perforator 36.

The volume control chamber 15 has a flange 31, about the upper portion thereof, which serves to rest the volume control means on an inner rim 32 about the hopper opening 12. This flange 31 forms an obstacle preventing alumina from passing through opening 12 when the volume control means is in position.

The crust breaker 10 comprises a pneumatic jack 33 which is fixed at its upper end to frame 6 by insulating bolting 34. A rod extension 35 on the jack 33 carries a tool 36 for perforating the crust. A guide for the extension 35 carries an insulating shoe 38 and a scraper 39. When the perforating tool 36 is raised by jack 33, the scraper 39 removes any crusts of electrolyte which may have stuck to the tool 36.

A central pneumatic station controlling the jacks 19 and 33 is located in a housing 40 provided at the top of the casing. Appropriate means are provided communicating the crust breaker and volume control with the central station. Controls for pneumatic and electric connections between the central station and the tank are arranged on the side of the tank, so that they can be manipulated without going onto the tank. The compressed air from the pneumatic system is released in the housing 40 by means of a silencer 41. Finally, the hopper 1 has a sealable filling aperture (not shown) at the top. Through this aperture it is recharged periodically with alumina from a central store, either by means of a pneumatic or fluidizing conveyor of the air carrying type, or from a container carried by an overhead crane, in the customary manner.

The system according to the invention operates as follows: When a perforating and volume control unit is to be exchanged, the apparatus positioned over the tank is put out of operation, the electrical controls are interrupted and the supply of compressed air is disconnected. A special lifting beam comes into position on the tank above the apparatus in question, and an automatic ratchet mechanism is locked onto a ring 42 provided on the supporting frame 6. The lifting beam also carries a pneumatic key which unlocks the apparatus from the superstructure.

An operator opens a hood on the tank opposite the alumina feed arrangement in question. Using an extension piece, he places a receptacle about and under the alumina spout 18; the receptacle may be held under the spout by any appropriate hanging arrangement.

The crust breaking and feed arrangement can then be removed. The alumina remaining in the hopper then flows through the aperture 12 in the bottom of the hopper and through the spout, until the receptacle placed below the spout is full. An alumina siphon is created, which stops its flow naturally. The alumina hopper also stays full.

The faulty apparatus is placed on a special rack to be taken to the maintenance workshop. An apparatus in working condition is picked up by the same lifting beam. The replacement apparatus is lowered into the empty case 4 until the bottom of the volume control means butts against the alumina which is then at the bottom of the hopper overlying the spout and the aperture for the volume control means. The receptacle placed under the spout is removed. The alumina starts flowing, and the dispenser and volume control means 11 simultaneously takes up its position in the aperture 12 at the bottom of the hopper. The weight of the whole arrangement then presses the volume control means 11 onto its seat 32 by means of the spring 20, and the alumina stops flowing. Thus a maximum of from 2 to 5 kg of alumina have been allowed to flow into the tank. The lock of the apparatus is closed. The pneumatic and electrical connections are re-established and the system is put back into operation. The disturbance caused to the electrolytic tank by the exchange of apparatus may be regarded as negligible.

The use of the invention has another advantage, it is possible to provide a constriction 43, e.g. at the top of the hopper, forming a compartment 44 together with the inner wall of the horizontal girders 2. The compartment 44 may be used as the main collector for the gases given off by the tank. This halves the quantity of sheet steel needed to make the collector.

We claim:

1. A system for spot feeding alumina into a tank for producing aluminum by electrolysis of alumina dissolved in molten cryolite, comprising; a fixed hopper over the tank and formed in part by horizontal girders, said girders forming a portion of the superstructure of the tank, crust breaking means for making a hole in the crust of solidified electrolyte, which covers the surface of the tank in normal operation, and alumina feed control means for feeding controlled doses of alumina into the hole, said hopper having a bottom aperture for discharge of the alumina, an impervious case positioned vertically in said hopper, said case having an open upper end substantially at the level of the upper portion of the hopper, said case, in spaced relation below the open upper end, having two substantially parallel depending branches, a first branch downwardly opening outside the hopper, and the second branch opening inside the hopper, in the immediate vicinity of the aperture for the discharge of alumina, the crust breaking means being positioned detachably in the first branch of the case, and the alumina feed means being positioned detachably in the second branch of the case, and a support overlying and generally sealing the open upper end of the case, the crust breaking means and the alumina feed means being fixed to said support with the support being common to the feed means and the crust breaking means, said support, feed means, and crust breaking means being removable from the hopper as a unit.

2. The system of claim 1, including a tubular means extending from the bottom aperture of the hopper for discharge above and in the immediate vicinity of the hole in the crust of electrolyte.

3. The system of claim 1, wherein the upper portion of the hopper has a constriction forming a compartment together with a wall of the hopper, the compartment being used as a collector for the gases released by the electrolytic tank.

4. A system for spot feeding alumina into a tank for producing aluminum by electrolysis of alumina dissolved in molten cryolite, comprising; a hopper over the tank, crust breaking means for making a hole in the crust of solidified electrolyte, which covers the surface of the tank in normal operation, and alumina feed control means for feeding controlled doses of alumina into the hole, said hopper having a bottom aperture for discharge of the alumina, an impervious case positioned vertically in said hopper, said case having an open upper end substantially at the level of the upper portion of the hopper, said case, in spaced relation below the open upper end, having two substantially parallel depending branches, a first branch downwardly opening outside the hopper, and the second branch opening inside the hopper, in the immediate vicinity of the aperture for the discharge of alumina, the crust breaking means being positioned detachably in the first branch of the case, and the alumina feed means being positioned detachably in the second branch of the case, and a support overlying and generally sealing the open upper end of the case, the crust breaking means and the alumina feed means being fixed to said support with the support being common to the feed means and the crust breaking means, said support, feed means, and crust breaking means being removable from the hopper as a unit.

* * * * *